United States Patent [19]

Voorheis

[11] 4,201,539

[45] May 6, 1980

[54] FLAME FORMING BURNER

[75] Inventor: Temple S. Voorheis, Atherton, Calif.

[73] Assignee: Coen Company, Inc., Burlingame, Calif.

[21] Appl. No.: 866,314

[22] Filed: Jan. 3, 1978

[51] Int. Cl.[2] ..... F23D 13/40

[52] U.S. Cl. ..... 431/354

[58] Field of Search ..... 431/354, 182, 185, 174, 431/187, 188, 13, 12, 90; 239/402

[56] References Cited

U.S. PATENT DOCUMENTS

| | | | |
|---|---|---|---|
| 3,285,315 | 11/1966 | Voorheis | 431/174 |
| 3,409,383 | 11/1968 | Voorheis | 431/174 |
| 3,563,470 | 2/1971 | Suzuki | 431/187 |
| 3,700,376 | 10/1972 | Niepenberg et al. | 431/188 |
| 3,748,087 | 7/1973 | Shular | 431/187 |
| 3,765,345 | 10/1973 | Binasik et al. | 431/187 |
| 4,049,021 | 9/1977 | Fromm et al. | 431/188 |

*Primary Examiner*—Albert W. Davis
*Assistant Examiner*—Wesley S. Ratliff, Jr.
*Attorney, Agent, or Firm*—Townsend and Townsend

[57] ABSTRACT

A flame forming burner for simultaneously minimizing excess air consumption while suppressing $NO_x$ emissions. A dual zone air register is provided to supply primary air in substoichiometric quantity into mixture with fuel to produce a flame in a primary zone. Additional air is introduced around the flame and downstream of the initial combustion site in a secondary zone, in sufficient quantity to complete combustion. In the preferred embodiment, primary air is provided through a venturi throat, and secondary air is provided through an annular passage equipped with vanes which generate dual counter-rotating (DCR) air flow surrounding the primary zone. Dampers for each register control the primary to secondary air ratio. Preferably, a divergent, non-circular throat provides flame shaping.

6 Claims, 2 Drawing Figures

FLAME FORMING BURNER

BACKGROUND OF THE INVENTION

1. Field of Invention

This invention relates to burners for firing fuels such a fuel oil, fuel gas, pulverized coal, and also methanol, hydrogen, waste oils, ground cellulose and the like. In particular, the invention relates to a burner having a dual zone air register, adapted to simultaneously minimize excess air consumption and $NO_x$ pollutant production.

2. Reference to Related Patents

U.S. Pat. No. 3,391,981 describes a burner having a circular dual counter-rotating air register. U.S. Pat. Nos. 3,409,383 and 3,765,345 teach elliptical flame forming burner throats. All of these patents are subjects of assignment to the named assignee.

3. Description of Prior Art Considerations

In the design of fuel burners, a number of complex, interrelated considerations must be taken into account, including efficiency, $NO_x$ emission, particulate emission, and the like. Prior fuel burners, although widely accepted, are still susceptible to improvement of certain of these performance criteria, particularly in view of contemporary concerns over fuel conservation and pollution.

Accordingly, the primary object of the present invention is to provide an improved fuel burner adapted to minimize excess air consumption, while simultaneously minimizing $NO_x$ emissions.

Another object of the present invention is to provide such an improved fuel burner which may be employed with a non-circular, e.g. elliptical, burner throat to afford flame shaping with its attendant benefits.

SUMMARY OF THE INVENTION

According to the present invention, a fuel burner having a dual zone air register is provided. The primary register provides parallel air flow through the burner venturi, in substoichiometric quantity, for mixing with fuel introduced by a fuel nozzle located in the diverging section of the venturi. A secondary air register in the form of an annulus around the primary register introduces the balance of the air necessary for complete combustion, downstream of the ignition site. In the preferred embodiment, the secondary air register includes two annularly disposed sets of diverter vanes arranged in a sense opposing one another to create dual counter-rotating (DCR) air flow concentric with and downstream of the ignition site, to promote mixing of the fuel and air to achieve complete combustion with minimum excess air. Separate dampers for each register permit balancing of the air flow for varying firing rates. In addition, a non-circular, divergent burner throat may be employed to afford flame shaping, to increase volumetric utilization of the combustion chamber.

In operation, the burner produces a flame base in the primary combustion zone by mixing parallel flow air in substoichiometric quantity with fuel. Such conditions have been found to minimize $NO_x$ production at the flame base. Additional air from the secondary register is introduced around the flame to achieve complete combustion with minimum excess air. The DCR type secondary register produces substantially uniform peripheral air flow entry provided by the flow restricting effect of the vanes which promotes a uniform controlled mixing of the burning fuel and secondary air.

The purpose of the two oppositely rotated air streams is for each to cancel out the rotation of the other, the principal object being to ensure uniform periphery air flow by the flow restricting and flow balancing effect of the vanes. In this manner, air is not ingested so quickly as to produce $NO_x$ pollutants or so slowly as to produce particulate emissions.

BRIEF DESCRIPTION OF THE DRAWINGS

These and other objects, features and advantages of this invention will be apparent after examination of the following detailed description of the preferred embodiment taken in conjunction with the accompanying figures in which.

DETAILED DESCRIPTION OF PREFERRED EMBODIMENT

Figure 1:
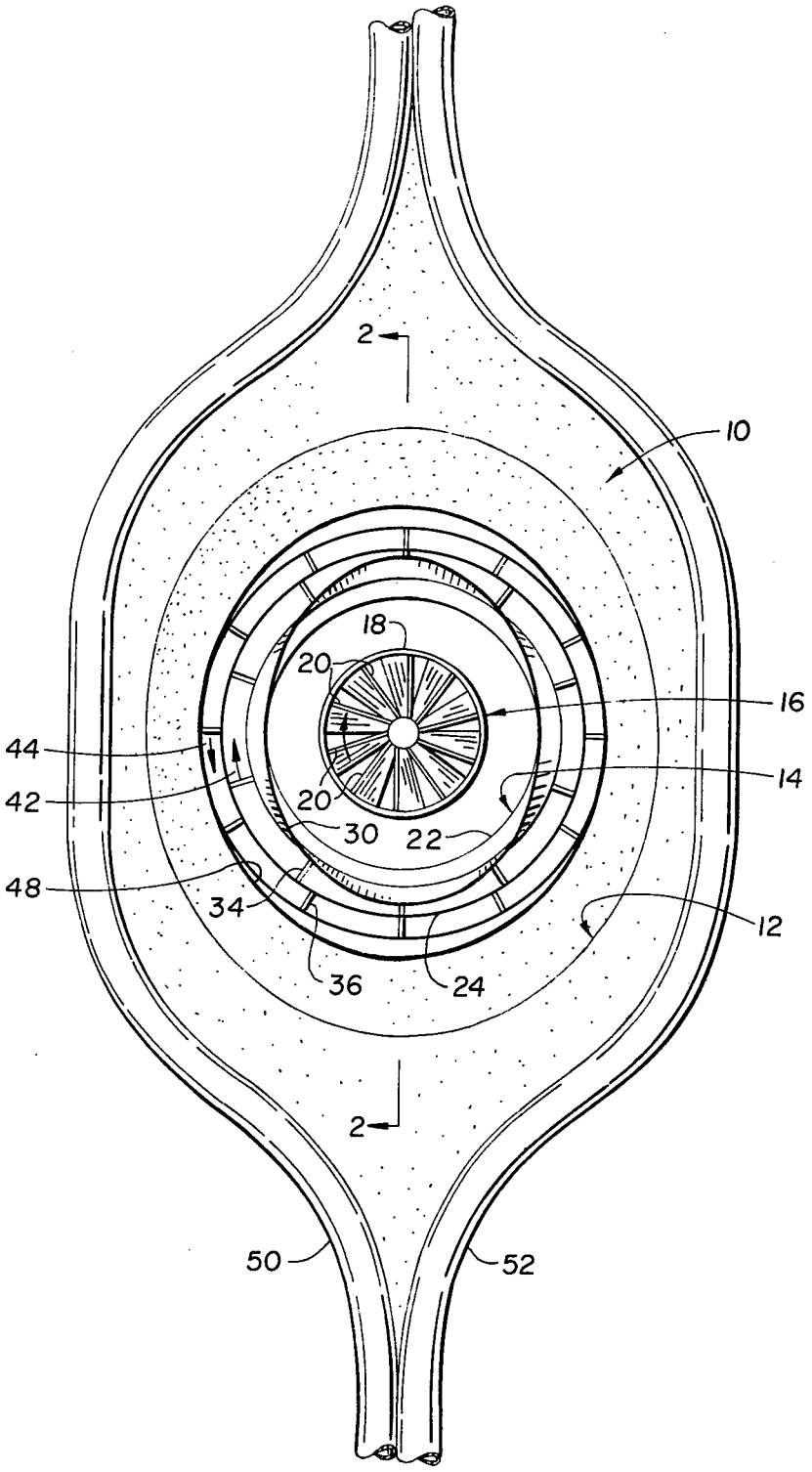
FIG. 1 is a front elevational view of a burner according to the invention as viewed from the interior of a furnace.

The fuel burner 10 according to the present invention generally comprises a refractory burner throat 12, an oxidizing gas or air induction register 14 and a fuel injection nozzle 16 comprises an oil injection nozzle, rendering the preferred embodiment an oil burner. Of course, different fuel introduction means suitable for use with other fuels may be substituted to fire gas, pulverized coal, or other fuels. It should be expressly understood that the present invention is depicted and described as an oil burner for exemplary purposes only. Two suitable types of nozzles 16 for firing oil are the "MV" steam atomizer and the "MW" mechanical atomizer with steam assist, as manufactured by Coen Company of Burlingame, California.

The air register 14 according the present invention comprises an inner air passage hereafter called the parallel zone register 22 and an outer annular air passage hereafter called the dual counter-rotating (DCR) zone register 24. Parallel zone 22 comprises a venturi throat 26 feeding air from a first axially translatable damper 28 to the venturi outlet throat 30.

Nozzle 16 is located on axis within parallel zone 22 by a fuel pipe which feeds fuel to the nozzle 16. An igniter 32 is placed in parallel zone 22 adjacent fuel nozzle 16. Nozzle 16 includes a flame stabilizer 18 comprising an array of pitched radial blades 20 arranged to create vortex flow at the point where fuel enters into mixture with the oxidizing gas or air. The arrow in FIG. 1 within stabilizer 18 indicates direction of air circulation through blades 20.

The secondary or DCR zone register 24 is located downstream of parallel zone 22, in an annular region in the form of a short throat concentrically disposed about the parallel zone 22. The DCR register 24 includes first and second sets of concentrically arranged flow diverting blades 34 and 36. The first blade set 34 is inboard of the second set 36 and is mounted around the outside of the wall forming throat 26. The first blades 34 are individually pitched to direct through-flowing fluid initially in a tangential direction. The second blade set 36 is mounted between an outer shell 38 of the register 14 and a tubular wall 40 separating blade set 34 therefrom. The second blades 36 are pitched to direct initial flow tangentially in a sense opposing the circulation pattern of first blades 34. The initial flow pattern is indicated by the arrows 42, 44 of FIG. 1.

The DCR zone 24 is intended to produce sufficient turbulence of the flow pattern downstream of the flame stabilizer 18 to promote eventual complete combustion. Air emanating from the DCR zone 24, that is, downstream in throat ream in outlet 12, is free to expand radially, and has minimal tangential component as the two counter-rotating streams of air are introduced at approximately equal mass and velocity. This effect is a consequence of a common air supply, namely an adjustable damper 46 and the mutual cancellation of tangential momentum by the adjacent air streams.

The counter-rotating air flow pattern is established at the entrance of throat 12 at an annular region between a contoured inner ring 30 and a concentric, contoured outer ring 48. At the downstream end, ring 48 is contiguous with the entrance margin of throat 12. The rings 30 and 48 each define circular orifices at the upstream side to mate the circular register 14 to the non-circular, e.g. elliptical throat 12.

Throat 12 may be formed of refractory material such as segmented refractory bricks and preferably continues the contour pattern established by rings 30 and 48 such that it is flared symmetrically along one transverse plane and is flattened along the orthogonal transverse plane. The flattened portion renders it considerably easier to locate a burner in a furnace wall, since cooling tubes, such as tubes 50 and 52 of FIG. 1, need not be so widely spread to accommodate the burner.

Figure 2:
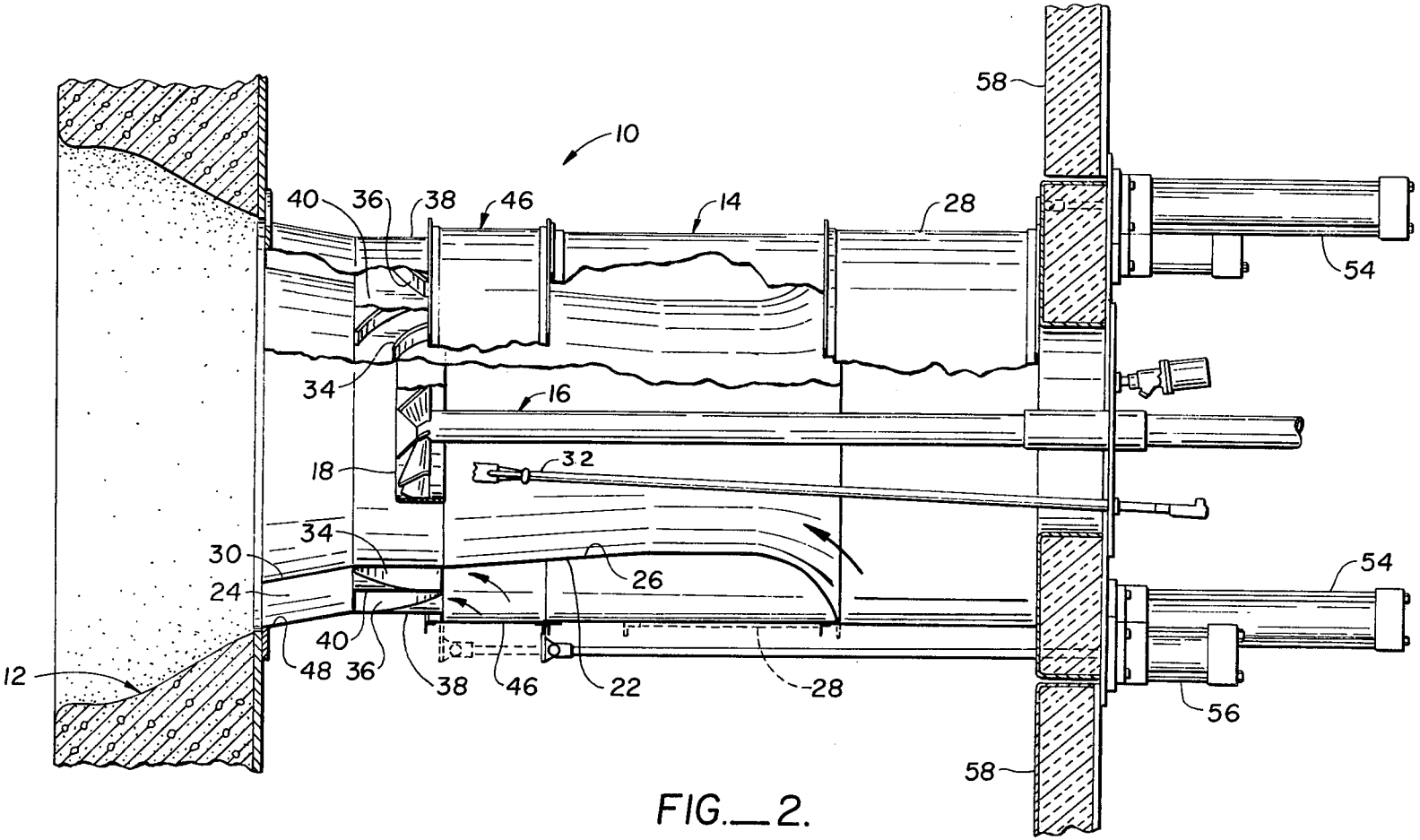
FIG. 2 is a side elevational view, in partial cross section along line 2—2 of FIG. 1.

A burner according to the invention preferably includes remotely controllable air damper actuators. In FIG. 2, a first damper actuator set 54 is shown mounted at the rear of burner 10 behind the front wall of the windbox 58. First damper actuator 54 controls parallel zone dampers 28. A second damper actuator 56 controls DCR zone dampers 46. In each case, the actuator comprises a linear cylinder with a translatable piston connected to a damper gate operative to slide the gate open and closed.

The dampers 28 and 46 are used to control the ratio of primary air to secondary air from the forced draft windbox 58. The primary dampers 38 preferably may have a capacity of only 66% of stoichiometric at the maximum firing rate. At low firing rates, for example below a 60% firing rate, the secondary zone registers may be closed to prevent secondary zone air from escaping ingestion in the flame. Between a 66% and 100% fire rate, the secondary zone registers may be progressively opened to take advantage of the secondary zone controlled mixing to achieve complete combustion. At maximum firing rate, the air is apportioned between the primary zone 22 and the DCR zone 24 such that approximately one-sixth of the total required air flow is introduced into throat 12 through each of the blade sets 34 and 36 of DCR zone 24. The initial two-thirds of stoichiometric air is provided through the parallel zone 22.

Having thus explained the structural features of the present invention, it is helpful to consider the operation of the apparatus. A relatively low temperature flame base is established in the primary flame zone by combustion of fuel from nozzle 16 in the parallel flow from register zone 22. The stabilizer 18 creates eddies to steady the flame base. As the flame progresses downstream, the flame expands and the air necessary to complete combustion is controllably mixed downstream of the DCR zone register 24. The swirling created by the dual counter-rotating secondary air assures good localized mixing as the flame develops. Substantially all air is ingested in the flame prior to exhaust from the furnace. However, the air is ingested relatively slowly to minimize production of $NO_x$ pollutants but sufficiently rapidly to prevent particulate emission.

Using the non-circular divergent throat 12 to shape the flame, a flame pattern is established substantially filling the combustion chamber. The "throw," i.e., the longitudinal extent, of the flame for a given capacity flame may be reduced by such a flared throat 12. This allows use of relatively fewer burners in a multiple burner furnace for a given combustion chamber depth.

At less that 100% firing rate, the DCR damper 46 may be partially opened to produce the counter-rotating flow pattern circumferentially about the flame in sufficient quantity to achieve complete combustion with low excess air. At firing rates less than 60%, the damper 46 may be fully closed so that burner 10 functions in a manner similar to conventional burners. Since firing rate is reduced the problem of $NO_x$ emission is minimized.

With the invention thus explained, it will be obvious that adaptations and modifications can be made without departing from the scope of the invention. It is therefore intended that the invention be limited only as indicated by the appended claims.

What is claimed is:

1. Apparatus for burning fuel comprising:

means operative to supply a controlled amount of fuel along a central axis to an ignition site;

primary register means concentrically disposed about said fuel supply means, said primary register means being constrained to supply a parallel flow of oxidizing gas to said ignition site in sub-stoichiometric quantity; and secondary register means concentrically disposed about said primary register means and having an outlet at a secondary zone surrounding said ignition site, said secondary register means comprising an annular chamber having a first annular array of blades pitched to impart slight rotational flow in one circumferential direction and a second annular array of blades pitched to impart rotational flow in the opposite circumferential direction, said second array being disposed concentrically about and substantially in a common plane with said first array, the outlet areas of said first array and said second array being of substantially equal cross-sectional area so that counter-rotating streams of oxidizing gas can be introduced through each one of said arrays of said secondary register means at approximately equal mass and velocity from a common source providing a mix-inducing substantially uniform peripheral secondary flow while canceling out circumferential flow components for supplying a secondary flow of oxidizing gas not substantially downstream and surrounding said ignition site, said secondary flow being constrained to be in the minimum quantity to achieve complete combustion with low excess air.

2. Apparatus according to claim 1 wherein said primary register means comprises a venturi throat upstream of said fuel supply means.

3. Apparatus according to claim 1 wherein said primary register means delivers about $\frac{2}{3}$ stoichiometric quantity of oxidizing gas at maximum firing rate.

4. Apparatus according to claim 1 wherein said secondary register means further comprises a downstream end portion which diverges outwardly with respect to its upstream portion to define an oval exhaust exit.

5. Apparatus according to claim 4 wherein said oval exit comprises an elliptical exit.

6. Apparatus according to claim 4 wherein the end portion of said primary register means diverges outwardly similar to the end portion of said secondary register means to define a corresponding inner oval exit for said primary register means.

* * * * *